US008904974B2

(12) United States Patent
Pae et al.

(10) Patent No.: US 8,904,974 B2
(45) Date of Patent: Dec. 9, 2014

(54) ELECTRIC WATER PUMP CONTROL SYSTEM AND METHOD THEREOF

(75) Inventors: Sangsoo Pae, Hwasung-si (KR); Young Jin Kim, Suwon-si (KR); Jung Jae Han, Incheon-si (KR); Seung Woo Ko, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 261 days.

(21) Appl. No.: 13/214,635

(22) Filed: Aug. 22, 2011

(65) Prior Publication Data

US 2012/0137991 A1 Jun. 7, 2012

(30) Foreign Application Priority Data

Dec. 3, 2010 (KR) ..... 10-2010-0123052

(51) Int. Cl.

| | |
|---|---|
| ***F01P 7/14*** | (2006.01) |
| ***F04B 49/06*** | (2006.01) |
| ***F04B 49/02*** | (2006.01) |
| *F02P 5/04* | (2006.01) |
| *F01P 7/16* | (2006.01) |
| *F01P 5/12* | (2006.01) |
| *F01P 7/10* | (2006.01) |

(52) U.S. Cl.

CPC . *F04B 49/06* (2013.01); *F02P 5/04* (2013.01); *F01P 7/16* (2013.01); *F01P 5/12* (2013.01); *F01P 7/10* (2013.01); *F01P 7/167* (2013.01); *F01P 2007/146* (2013.01); *F01P 2060/08* (2013.01); *F01P 7/164* (2013.01); *F01P 2025/30* (2013.01); *F01P 2025/62* (2013.01); *F01P 2025/66* (2013.01); *F04B 49/02* (2013.01); *F04B 2203/0205* (2013.01); *F04B 2203/0209* (2013.01); *F04B 2205/10* (2013.01); *F04B 2205/11* (2013.01)

USPC ..... 123/41.1

(58) Field of Classification Search

CPC ..... F01P 7/16; F01P 7/167; F01P 2007/146; F01P 2060/08; F01P 2052/62; F01P 5/04; F01P 7/046; F01P 7/804; F01P 2025/66; F01P 5/12; F01P 7/042; F01P 7/08; F01P 7/044; F01P 7/087; F01P 7/10

USPC ..... 123/41.1

See application file for complete search history.

(56) References Cited

U.S. PATENT DOCUMENTS 3,026,928 A * 3/1962 Phillips et al. ..... 180/54.1
2002/0152972 A1* 10/2002 Iwasaki et al. ..... 123/41.44

(Continued)

FOREIGN PATENT DOCUMENTS

JP 3156209 B2 2/2001
JP 2008-255871 A 10/2008

(Continued)

*Primary Examiner* — Lindsay Low
*Assistant Examiner* — Charles Brauch
(74) *Attorney, Agent, or Firm* — Morgan, Lewis & Bockius LLP

(57) ABSTRACT

An electric water pump control apparatus actively controls an electric water pump in a high speed range or a high load condition as a vehicle accelerates or overtakes. An electric water pump control method may include determining whether an engine is in a high speed/high load condition or in a normal condition by detecting an engine speed, fuel consumption amount, and coolant temperature, determining whether the coolant temperature is less than a predetermined second temperature, if the engine is in a high speed/high load condition, calculating a speed of the electric water pump by applying fuel consumption amount and engine speed, if the coolant temperature is less than a second temperature and determining a final speed of the electric water pump by applying a compensation coefficient according to the coolant temperature, and operating the electric water pump with the final speed to circulate the coolant.

11 Claims, 2 Drawing Sheets

(56) References Cited

U.S. PATENT DOCUMENTS

| | | | | |
|---|---|---|---|---|
| 2005/0131613 | A1* | 6/2005 | Bohm et al. | 701/71 |
| 2009/0204297 | A1* | 8/2009 | Friedman | 701/46 |
| 2009/0255488 | A1* | 10/2009 | Shiobara et al. | 123/41.1 |

FOREIGN PATENT DOCUMENTS

| | | | |
|---|---|---|---|
| JP | 2010-96020 | A | 4/2010 |
| KR | 10-2011-0023147 | A | 3/2011 |
| KR | 10-2011-0063167 | A | 6/2011 |

* cited by examiner

ELECTRIC WATER PUMP CONTROL SYSTEM AND METHOD THEREOF

CROSS-REFERENCE TO RELATED APPLICATION

The present application claims priority of Korean Patent Application Number 10-2010-0123052 filed Dec. 3, 2010, the entire contents of which application is incorporated herein for all purposes by this reference.

BACKGROUND OF INVENTION

1. Field of Invention

The present invention relates to an electric water pump applied to a vehicle. More particularly, the present invention relates to an electric water pump control apparatus that actively controls an electric water pump in a high speed range or a high load condition that a vehicle accelerates or overtakes and the method thereof.

2. Description of Related Art

A coolant passage is formed between a cylinder block and a cylinder head of an engine, and a water pump circulates a coolant through the coolant passage so as to prevent overheating of the engine and sustain a regular temperature.

A water pump is engaged with auxiliary devices through a belt to be continuously operated to circulate the coolant regardless of a warmed up condition or a cold condition of the engine.

Accordingly, the fuel efficiency and the exhaust gas are stabilized in a condition that the engine is warmed up, but the fuel efficiency is low and the exhaust gas quality is deteriorated, the warming period of the engine becomes longer, and a friction loss is increased in a condition that the engine is cold.

Also, since combustion efficiency is decreased to warm up a cold engine, fuel consumption is increased, an activation time of a exhaust gas catalyst is delayed, and harmful material in the exhaust gas is increased.

In addition, as the water pump is always operated, there is a problem that the power of the crankshaft is lost in such a manner that the output of the engine is deteriorated and the fuel efficiency becomes lower.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for an engine cooling apparatus having advantages of securely protecting an engine by controlling actively an electric water pump in a high speed/high load condition that heat load thereof is high by overtaking or rapid acceleration.

Also, various aspects of the present invention provide for an optimized cooling efficiency by actively controlling an electric water pump according to a driving and atmosphere condition of a vehicle.

An engine cooling apparatus according to various aspects of the present invention may include a thermostat that determines a coolant circulation direction according to a coolant temperature, a radiator that emits absorbed heat to atmosphere by expanding contact area of the coolant with air through core, an electric water pump that is disposed between an engine and the thermostat and that an operating speed thereof is controlled, a coolant temperature sensor that is configured to detects a coolant temperature, and a control portion that applies an engine speed and fuel consumption amount to determine an operating speed of the electric water pump and applies a compensation coefficient to the operating speed according to a coolant temperature, if the engine is operated at high speed or in a high load condition that the heat load thereof is high.

The control portion may determine that the engine is in a high speed or in a high load condition, if the rotation speed of the engine exceeds a predetermined value or the fuel consumption amount exceeds a predetermined value.

The control portion may operate the electric water pump at regular speed, if an air-conditioner is being operated in a condition that the coolant temperature detected by the coolant temperature sensor is lower than a predetermined second temperature that a thermostat is opened.

The control portion may detect a driving condition and an outside condition of the engine and if an error is detected, it enters into a limp home mode to operate the electric water pump at predetermined regular speed.

The control portion may detect a driving condition and an outside condition of the engine and if an error is detected, it enters into a limp home mode to operate the electric water pump at predetermined regular speed.

The control portion may determine ON time or OFF time of the electric water pump according to an engine speed and fuel consumption amount and applies a compensation coefficient to the ON time or the OFF time according to the coolant temperature to on/off control the electric water pump, if the coolant temperature is lower than a predetermined first temperature that is a boundary value to determine a cold state of the engine.

The control portion may operate the electric water pump at a first speed that the coolant can flow the engine at the least to cool the thermostat, if the coolant temperature detected by the coolant temperature sensor ranges between the first temperature and the second temperature.

The control portion may apply an engine speed and fuel consumption amount to determine a coolant target temperature and determines a target speed that can realize the coolant target temperature to operate the electric water pump with the target speed, if the coolant temperature exceeds the second temperature.

The control portion may decrease a coolant target temperature to operate the electric water pump at a high speed, if the coolant temperature exceeds the second temperature and the engine is in a high speed or in a high load condition that the heat load thereof is high.

Also, an electric water pump control method according to various aspects of the present invention may include determining whether an engine is in a high speed/high load condition or in a normal condition by detecting an engine speed, fuel consumption amount, and coolant temperature, determining whether the coolant temperature is less than a predetermined second temperature, if the engine is in a high speed/high load condition, calculating a speed of the electric water pump by applying fuel consumption amount and engine speed, if the coolant temperature is less than a second temperature and determining a final speed of the electric water pump by applying a compensation coefficient according to the coolant temperature, and operating the electric water pump with the final speed to circulate the coolant.

A target temperature of coolant may be determined according to fuel consumption amount and engine speed and a speed of the electric water pump is variably controlled to follow the target temperature, if the engine is in a high speed/high load condition and the coolant temperature exceeds the second temperature.

The electric water pump may be operated at a first speed, if an air conditioner is operated in a normal driving condition of the engine and the coolant temperature is less than the second temperature.

A target temperature of the coolant may be determined according to fuel consumption amount and engine speed and the speed of the electric water pump is variable controlled to follow the target temperature, if the air conditioner is operated and the coolant temperature exceeds the second temperature.

An ON time or OFF time of the electric water pump may be respectively calculated according to an engine speed and fuel consumption amount and a compensation coefficient is apply to the ON time or the OFF time according to the coolant temperature to on/off control the electric water pump, if the coolant temperature is lower than a predetermined first temperature that is a boundary value to determine a cold state of the engine in a normal driving condition of the engine.

The electric water pump may be operated at a first speed that the coolant can flow the engine at the least to cool the thermostat, if the coolant temperature detected ranges between the first temperature and the second temperature.

The electric water pump may be actively controlled by reflecting driving conditions, control conditions, and load conditions of the engine to optimize cooling performance and atmosphere of the engine such that fuel consumption efficiency is improved, abrasion is minimized, and durability is enhanced.

Also, warm up time of the engine and activation time of catalyst may be reduced to improve fuel consumption efficiency and quality of exhaust gas and to decrease unnecessary load loss such that efficiency of a battery is improved.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
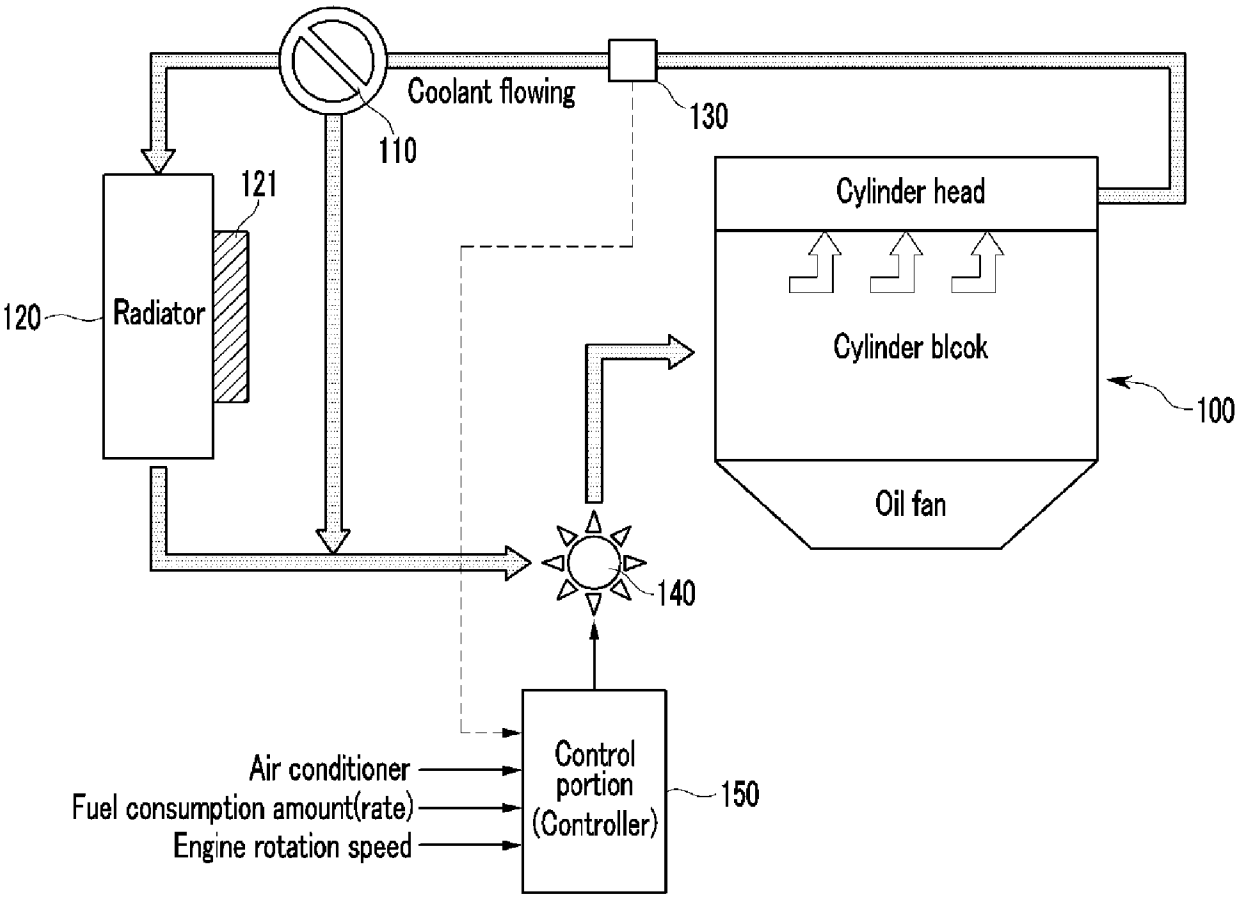
FIG. 1 schematically shows an exemplary electric water pump control apparatus according to the present invention.

Referring to FIG. 1, various embodiments of the present invention includes an engine 100, a thermostat 110, a radiator 120, a coolant temperature sensor 130, an electric water pump 140, and a control portion 150.

The thermostat 110 determines a circulation direction of coolant according to a coolant temperature exhausted from the engine 100 to the bypass line or the radiator 120 such that the engine 100 is cooled by the coolant.

The radiator 120 expands contact area of the coolant with the air through core to rapidly emit the heat absorbed in the coolant.

The cooling fan 121 is disposed at one side of the radiator 120 to blow air through the radiator 120, wherein the cooling fan 121 is operated in a slow or a high speed by a control signal transferred from the control portion 150 according to driving condition and coolant temperature in a condition that the coolant temperature is higher than a predetermined value.

The coolant temperature sensor 130 detects a temperature of the coolant circulating the engine 100 to transmit the detected signal to the control portion 150.

The coolant temperature sensor 130 can be disposed on the thermostat 110.

The electric water pump 140 is disposed between the engine and the thermostat 110 to be turned on/off or an operating speed thereof is controlled according to control signals transmitted from the control portion 150 to circulate the coolant.

The electric water pump 140 can be one of a clutch type of water pump and an electric water pump.

If it is determined that the engine 100 is being operated in a high speed/high load condition that heat load thereof is high in a condition that a rotation speed (RPM) of the engine 100 exceeds a predetermined rotation speed (RPM_T) or a fuel consumption amount (Q) exceeds a predetermined amount (Q_T), the control portion 150 applies the engine speed (RPM) and the fuel amount (Q) to determine operating speed of the electric water pump 140 and applies an compensation coefficient thereto according to a coolant temperature detected by the coolant temperature sensor 130 to on/off control the pump 140 or control the speed of the electric water pump 140.

If an air conditioner including a cooler or a heater is operated in a condition that the coolant temperature detected by the coolant temperature sensor 130 is less than a second temperature T2 (T>WTS), the control portion 150 can control the electric water pump 140 in a predetermined regular speed regardless of the coolant temperature.

The second temperature T2 can be a coolant temperature when the thermostat 110 is opened.

The control portion 150 detects atmosphere and driving conditions of the engine 100, if an error is detected in any position, an alarm message is outputted and simultaneously a limp home mode is performed, and the electric water pump 140 is operated at a predetermined regular speed.

If the coolant temperature detected by the coolant temperature sensor 130 is less than a first temperature T1 (T1>WTS), The control portion 150 determines operating time and none-operating time of the electric water pump 140 according to a rotation speed (RPM) and a fuel consumption amount of the engine 100 and applies a compensation coefficient thereto according to the coolant temperature to change (compensate) the operating time and the none-operating time of the electric water pump 140.

The first temperature T1 is set to a maximum temperature that is compensated by the control portion 150 in a cold state of the engine.

In a condition that the coolant temperature detected by the coolant temperature sensor 130 ranges between a first temperature (T1) and a second temperature (T2) (T1<WTS<T2), the control portion 150 steadily operates the electric water pump 140 in a first speed such that a coolant at least circulates the engine 100 to cool the thermostat 110.

If the coolant temperature detected by the coolant temperature sensor 130 is larger than a second temperature (T2<WTS), the control portion 150 applies an engine speed (RPM) and a fuel amount (Q) to determine a target temperature of the coolant and determines a rotation speed of the pump 140 such that the coolant follows the target temperature.

The higher the target temperature of the coolant the better the fuel consumption efficiency. However, if the target temperature is too high, the exhaust gas can violate the emission standard and the heat load of the engine 100 becomes excessive. Therefore, the target temperature is determined in two aspects of the emission standard and the engine protection.

If the coolant temperature detected by the coolant temperature sensor 130 exceeds a second temperature (T2) (T2<WTS) and heat load of the engine 100 is high by an overtaking or a rapid acceleration, the control portion 150 sets up the target temperature of the coolant low to operate the electric water pump 140 at high speed.

Figure 2:
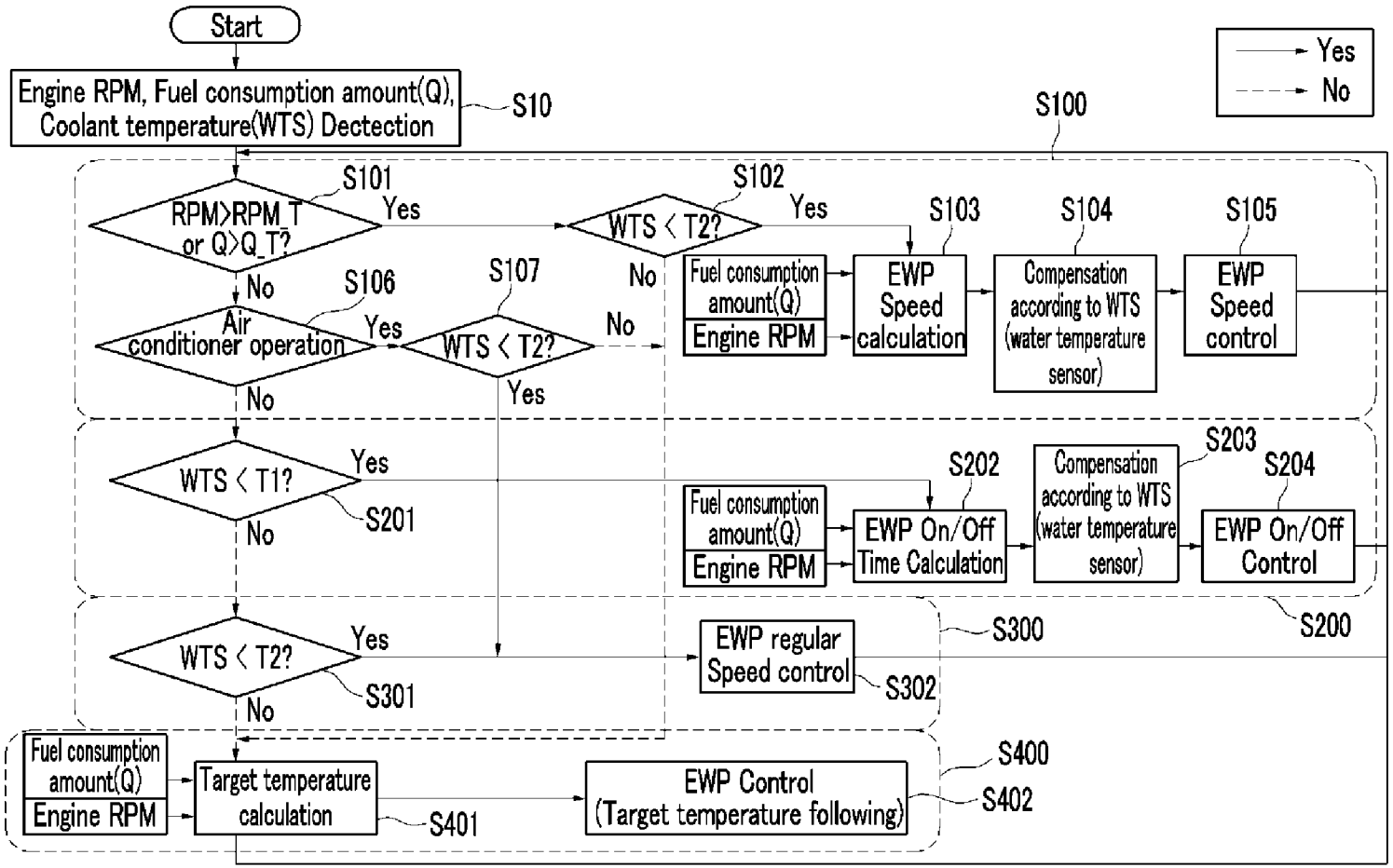
FIG. 2 is a flow chart showing exemplary electric water pump control procedures according to the present invention.

Operations of this invention including the function as described above will hereinafter be described in detail with reference to FIG. 2.

In a condition that a vehicle is running according to various embodiments of the present invention, the control portion 150 detects rotation a speed (RPM) and a fuel amount (Q) of the engine 100 and detects the coolant temperature (WTS) from the coolant temperature sensor 130 in a S10.

Then, it is determined whether an engine speed (RPM) exceeds a minimum engine speed (RPM_T) that is set to protect the engine 100 or a fuel consumption amount (Q) exceeds a minimum amount (Q_T) that is set to protect the engine 100 in a S101.

That is, it is determined whether the engine 100 is in a high speed or high load condition by an overtaking or a rapid acceleration.

If the engine speed (RPM) exceeds a minimum speed (RPM_T) that is set to protect the engine 100 or the fuel consumption amount (Q) exceeds a minimum amount (Q_T) that is set to protect the engine 100 in the S101, the control portion 150 determines whether the coolant temperature detected by the coolant temperature sensor 130 is less than a second temperature T2 (WTS<T2) in a S102.

If the coolant temperature detected by the coolant temperature sensor 130 is less than a second temperature T2 (WTS<T2) in the S102, the control portion 150 applies a fuel amount (Q) and an engine speed (RPM) to calculate a speed of the electric water pump 140 in a S103.

And, the control portion 150 extracts a compensation coefficient according to a present coolant temperature detected by the coolant temperature sensor 130 and applies the extracted coefficient to the speed of the electric water pump 140 to set up a final speed of the electric water pump 140 in a S104.

Accordingly, the control portion 150 operates the electric water pump 140 with the final speed to circulate the coolant in a S105.

If the engine speed (RPM) is less than a minimum speed (RPM_T) that is set to protect the engine 100 or fuel amount (Q) is less than a minimum amount (Q_T) that is set to protect the engine 100 in the S101, the control portion 150 determines whether a cooler or a heater is operated or not in a S106.

If it is determined that the air conditioner (cooler or heater) is operated in the S106, the control portion 150 determines whether the coolant temperature detected by the coolant temperature sensor 130 is less than a second temperature (T2) (WTS<T2) in a S107.

If the coolant temperature is less than a second temperature T2 (WTS<T2) in the S107, the control portion 150 operates the electric water pump 140 with a first speed that can at least circulate the coolant through the engine to cool the thermostat 110 in a S302.

Also, if the coolant temperature detected by the coolant temperature sensor 130 is larger than a second temperature T2 (WTS>T2) in the S102, since it is a high temperature condition that the thermostat 110 is opened to circulate the coolant through the radiator 120, the control portion 150 applies a fuel amount (Q) and an engine speed (RPM) to calculate a target temperature of the coolant in a S401.

Then, it variably controls the speed of the electric water pump 140 such that the coolant temperature follows the target temperature in a S402.

If it is determined that the air conditioner (cooer or heater) is not operated in the S106, the control portion 150 determines whether the coolant temperature detected by the coolant temperature sensor 130 is less than a first temperature T1 (WTS<T1) in a S201.

If the coolant temperature is less than a first temperature T1 (WTS<T1) in the S201, the control portion 150 applies an engine speed (RPM) and a fuel amount (Q) to calculate an operating time and a none-operating time of the electric water pump 140 in a S202, wherein the pump 140 is intermittently operated with the operating time and the none-operating time.

And, a compensation coefficient is extracted according to the coolant temperature detected by the coolant temperature sensor 130 and the compensation coefficient is applied to the ON time and the OFF time of the electric water pump 140 to determined a final ON time and a final OFF time in a S203, and then electric water pump 140 is controlled thereby in a S204.

If the coolant temperature is larger than a first temperature T1 (WTS>T1) in the S201, the control portion 150 determines whether the coolant temperature is less than a second temperature T2 (WTS<T2) in a S301.

If the coolant temperature detected by the coolant temperature sensor 130 ranges between a first temperature T1 and a second temperature T2 (T1<WTS<T2) in the S301, the control portion 150 operates the electric water pump 140 at a first speed such that the coolant can at least circulate the engine to cool the thermostat 110.

Also, if the coolant temperature detected by the coolant temperature sensor 130 is larger than a second temperature T2 (WTS>T2) in the S301, because it is a high temperature condition that the thermostat 110 is opened to circulate the coolant through the radiator 120, the control portion 150 applies a fuel amount (Q) and a engine speed (RPM) to calculate a target temperature of the coolant in a S401.

Then, it variably controls the speed of the electric water pump 140 such that the coolant temperature follows the target temperature in a S402.

The higher the target temperature of the coolant the better the fuel consumption efficiency. However, if the target temperature is too high, the exhaust gas can violate the emission standard and the heat load of the engine 100 becomes excessive. Therefore, the target temperature is determined in two aspects of the emission standard and the engine protection.

Accordingly, if the coolant temperature detected by the coolant temperature sensor 130 is larger than a second temperature T2 (T2<WTS) and heat load of the engine 100 is high by an overtaking or a rapid acceleration, the control portion 150 sets up the target temperature of the coolant low to operate the electric water pump 140 at high speed.

Referring to FIG. 1, the thermostat 110 is disposed at an outlet side of the radiator 120 between the pump 140 and the radiator 120. However, the thermostat 110 can be disposed at an inlet side of the radiator 120 between the engine 100 and the radiator 120. Generally, a mounting position of the sensor 130 is an outlet side of the engine.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine cooling apparatus, comprising:

a thermostat determining a coolant circulation direction according to a coolant temperature;

a radiator emitting absorbed heat to atmosphere by expanding contact area of the coolant with air through a core thereof;

an electric water pump disposed to pump the coolant and having a controlled operating speed;

a coolant temperature sensor configured to detect a coolant temperature; and a control portion that applies an engine speed and fuel consumption amount to determine an operating speed of the electric water pump, and which applies a compensation coefficient to the operating speed, the compensation coefficient being determined according to a coolant temperature, if an engine is operated at high speed or in a high load condition that the heat load thereof is high;

wherein the control portion determines whether the engine is in the high speed or in the high load condition, if a rotation speed of the engine exceeds a predetermined first value or the fuel consumption amount exceeds a predetermined second value, respectively, the predetermined first value and the predetermined second value being a minimum engine speed and a minimum fuel consumption amount that are respectively set so as to protect the engine;

wherein the control portion operates the electric water pump at regular speed, if an air-conditioner is being operated in a condition that the rotation speed of the engine is less than the minimum engine speed and the fuel consumption amount is less than the minimum fuel consumption amount that are respectively set so as to protect the engine and the coolant temperature detected by the coolant temperature sensor is lower than a predetermined second temperature that the thermostat is opened; and wherein the control portion detects a driving condition and an outside condition of the engine and if an error is detected, the control portion enters into a limp-home mode to operate the electric water pump at predetermined regular speed.

2. The engine cooling apparatus of claim 1, wherein the control portion determines ON time or OFF time of the electric water pump according to an engine speed and fuel consumption amount and applies a compensation coefficient to the ON time or the OFF time according to the coolant temperature to on/off control the electric water pump, if the coolant temperature is lower than a predetermined first temperature that is a boundary value to determine a cold state of the engine.

3. The engine cooling apparatus of claim 1, wherein the control portion operates the electric water pump at a first speed that the coolant can flow the engine at the least to cool the thermostat, if the coolant temperature detected by the coolant temperature sensor ranges between a first temperature and the second temperature.

4. The engine cooling apparatus of claim 1, wherein the control portion applies an engine speed and fuel consumption amount to determine a coolant target temperature and determines a target speed that can realize the coolant target temperature to operate the electric water pump with the target speed, if the coolant temperature exceeds the second temperature.

5. The engine cooling apparatus of claim 1, wherein the control portion decreases a coolant target temperature to operate the electric water pump at a high speed, if the coolant temperature exceeds the second temperature and the engine is in a high speed or in a high load condition that the heat load thereof is high.

6. An electric water pump control method, comprising:

determining whether an engine is in a high speed/high load condition or in a normal condition by detecting an engine speed, a fuel consumption amount, and a coolant temperature;

determining whether the coolant temperature is less than a predetermined second temperature, if the engine is in a high speed/high load condition, wherein the engine is determined to be in the high speed and in the high load condition, if a rotation speed of the engine or the fuel consumption amount respectively exceed a minimum engine speed and a minimum fuel consumption amount that are set so as to protect the engine;

calculating a speed of an electric water pump by applying the fuel consumption amount and the engine speed, if the rotation speed of the engine or the fuel consumption amount respectively exceeds the minimum engine speed and the minimum fuel consumption amount and the coolant temperature is less than a second temperature and, determining a final speed of the electric water pump by applying a compensation coefficient determined according to the coolant temperature; and operating the electric water pump with the final speed to circulate the coolant;

wherein a control portion detects a driving condition and an outside condition of the engine and if an error is detected, the control portion enters into a limp-home mode to operate the electric water pump at predetermined regular speed.

7. The electric water pump control method of claim 6, wherein a target temperature of coolant is determined according to the fuel consumption amount and the engine speed and a speed of the electric water pump is variably controlled to follow the target temperature, if the engine is in the high speed/high load condition and the coolant temperature exceeds the second temperature.

8. The electric water pump control method of claim 6, wherein the electric water pump is operated at a first speed, if the rotation speed of the engine or the fuel consumption amount respectively is less than the minimum engine speed and the minimum fuel consumption amount and an air conditioner is operated in a normal driving condition of the engine and the coolant temperature is less than the second temperature.

9. The electric water pump control method of claim 8, wherein a target temperature of the coolant is determined according to the fuel consumption amount and the engine speed and the speed of the electric water pump is variable controlled to follow the target temperature, if the air conditioner is operated and the coolant temperature exceeds the second temperature.

10. The electric water pump control method of claim 6, wherein ON time or OFF time of the electric water pump is respectively calculated according to the engine speed and the fuel consumption amount and a compensation coefficient is applied to the ON time or the OFF time according to the coolant temperature to on/off control the electric water pump, if the coolant temperature is lower than a predetermined first temperature that is a boundary value to determine a cold state of the engine in a normal driving condition of the engine.

11. The electric water pump control method of claim 6, wherein the electric water pump is operated at a first speed that the coolant can flow to the engine at the least to cool the thermostat, if the coolant temperature detected ranges between the first temperature and the second temperature.

* * * * *